US012790850B2

(12) United States Patent
Hick

(10) Patent No.: US 12,790,850 B2
(45) Date of Patent: Nov. 10, 2026

(54) BUILDING FOR CAR PARKS

(71) Applicant: X HOUSE LIMITED, Bourne (GB)

(72) Inventor: Karl Stephen Hick, Bourne (GB)

(73) Assignee: X HOUSE LIMITED, Bourne (GB)

( * ) Notice: Subject to any disclaimer, the term of this patent is extended or adjusted under 35 U.S.C. 154(b) by 51 days.

(21) Appl. No.: 18/702,263

(22) PCT Filed: Oct. 17, 2022

(86) PCT No.: PCT/GB2022/052646
§ 371 (c)(1),
(2) Date: Apr. 17, 2024

(87) PCT Pub. No.: WO2023/067324
PCT Pub. Date: Apr. 27, 2023

(65) Prior Publication Data

US 2025/0122743 A1 Apr. 17, 2025

(30) Foreign Application Priority Data

Oct. 18, 2021 (GB) ..... 2114839

(51) Int. Cl.
*E04H 6/02* (2006.01)
*E04B 1/348* (2006.01)

(52) U.S. Cl.
CPC ..... *E04H 6/025* (2013.01); *E04B 1/34807* (2013.01)

(58) Field of Classification Search
CPC ..... E04H 1/1205; E04H 1/005; E04H 6/025; E04B 1/348; E04B 1/34815; E04B 1/3483; E04B 1/34331; E04B 2001/34892
See application file for complete search history.

(56) References Cited

U.S. PATENT DOCUMENTS 1,336,166 A * 4/1920 Smulski ..... E04C 5/06 52/851
1,652,443 A * 12/1927 Katz ..... E04C 5/06 52/261
2,435,998 A * 2/1948 Cueni ..... E04B 5/263 52/223.8
2,765,499 A * 10/1956 Couse ..... E04B 1/3442 52/79.5

(Continued)

FOREIGN PATENT DOCUMENTS

EP 2 175 088 A2 4/2010
EP 2 175 088 A3 4/2010

OTHER PUBLICATIONS

International Search Report and Written Opinion on PCT App. PCT/GB2022/052646 dated Nov. 17, 2022 (13 pages).

*Primary Examiner* — Gisele D Ford
(74) *Attorney, Agent, or Firm* — Foley & Lardner LLP

(57) ABSTRACT

A building for a car park. The building includes: a platform; at least one habitable structure comprising a plurality of walls and a roof located on the platform; and a platform support assembly. The platform support assembly includes a first ground beam arranged to sit on the ground and a first support mounted on the first ground beam, wherein the first support is arranged to at least partly support the platform above a car park surface and to transfer loads from the platform to the first ground beam. A car park including the building and a method for construction the building is also disclosed.

21 Claims, 6 Drawing Sheets

(56) References Cited

U.S. PATENT DOCUMENTS 3,245,183 A * 4/1966 Tessin, II ..... E04H 1/005 52/282.5
4,006,566 A * 2/1977 Forgiarini ..... E04H 1/02 52/64
4,196,558 A * 4/1980 Jungbluth ..... E04C 3/293 52/340
4,719,716 A * 1/1988 Chrisley, Jr. ..... A01M 31/025 D25/16
4,723,381 A * 2/1988 Straumsnes ..... E04B 1/34807 52/79.12
4,930,273 A * 6/1990 Papesch ..... E04F 11/00 52/745.03
5,402,608 A * 4/1995 Chu ..... E04B 1/3483 52/79.9
6,357,550 B1 * 3/2002 Willson ..... E04H 1/1205 182/141
8,186,109 B2 * 5/2012 Warminsky ..... E04H 9/10 52/79.5
8,511,021 B2 * 8/2013 Salisbury ..... E21B 15/003 52/150
9,347,233 B2 * 5/2016 Rogers ..... H05K 7/1495
10,450,739 B1 * 10/2019 Schlagel ..... E04H 1/04
10,745,906 B1 * 8/2020 Houston ..... E04B 1/3544
10,794,030 B2 * 10/2020 Kemp ..... E02D 5/223
11,268,272 B2 * 3/2022 Schlagel ..... E04H 1/1205
11,598,066 B2 * 3/2023 Lim ..... E02D 27/01
2005/0210762 A1 * 9/2005 Broberg ..... E04C 3/32 52/79.9
2008/0276553 A1 * 11/2008 Ingjaldsdottir ..... E04C 2/521 52/302.1
2011/0056147 A1 * 3/2011 Beaudet ..... E04B 1/34869 52/79.9
2011/0214361 A1 * 9/2011 Ingjaldsdottir ..... E04B 1/34869 52/745.13
2013/0239487 A1 * 9/2013 Ingjaldsdottir ..... E04B 2/30 52/79.1
2013/0305629 A1 * 11/2013 Stephenson ..... E04H 1/005 52/79.9
2014/0115976 A1 * 5/2014 Lippert ..... E04H 1/005 52/79.2
2017/0030097 A1 * 2/2017 Marinoni ..... F24F 3/167
2017/0370091 A1 * 12/2017 Dragan ..... E04B 1/3511
2019/0249413 A1 * 8/2019 Brotherton ..... E04B 1/0007
2020/0040594 A1 * 2/2020 Hedberg ..... E04H 1/005
2020/0362550 A1 11/2020 Schlagel
2021/0040723 A1 * 2/2021 Lin ..... E04B 1/348
2021/0245849 A1 * 8/2021 Zierke ..... E04H 1/1205
2023/0332396 A1 * 10/2023 Kandrashou ..... E04B 1/04
2024/0084577 A1 * 3/2024 Mallinowski ..... E04B 1/19
2024/0254753 A1 * 8/2024 Reddel ..... E04B 1/58

* cited by examiner

BUILDING FOR CAR PARKS

CROSS-REFERENCE TO RELATED APPLICATIONS

This application is a U.S. National Phase Application under 35 U.S.C. § 371 of International Application No. PCT/GB2022/052646, filed on Oct. 17, 2022, which claims the benefit of and priority to GB Appl. No. 2114839.0, filed Oct. 18, 2021, each of which is incorporated herein by reference in their entirety for any and all purposes.

The invention relates to a building that is suitable for installation on a car park, and typically a pre-existing car park; a car park including said building; and a method for constructing the building.

There are many pre-existing car parks available. For example, many supermarkets, railway stations, sports stadia, and airports have large car parks. Typically, the land used for parking cars is used for that purpose only, and may only be used during certain hours of the day, for example when a supermarket is open. At other times, the car park may be unused.

As the population grows, there is pressure to increase the housing stock available, but at the same time, due to environment concerns, it is not desirable to build on green field sites, but rather to make use of existing sites, where possible.

The inventors have determined that it is possible to erect buildings on pre-existing car parks, or similar existing useable spaces, to provide additional housing, while at the same time allowing the space to continue to function as a car park, or its existing use. This increases the utilisation of the available space. Since many car parks are conveniently located adjacent facilities such as shops and railway stations, housing located on car parks will be attractive to some people. For example, many car parks are located in town centres, which have numerous facilities close to hand.

The inventors have determined that building on a pre-existing car park presents a unique set of challenges. For example, it is desirable to erect buildings as quickly as possible to minimise the amount of time that the car park is closed to vehicles, and to minimise the impact that the building works has on any adjacent facilities, such as shops. It is also desirable to erect buildings in a manner that minimises damage to the car park surface, while at the same time provides sufficient load bearing capacity to adequately support the weight of the building and to deal with horizontal loads, for example due to wind. Minimising the amount of damage to the car park reduces the amount of remedial work required to return the car park to a usable condition, and keeps building costs down. Additionally, buildings should be erected in a manner that does not significantly reduce the number of car parking bays that are available, when compared with the number of car parking bays that were available prior to the building works commencing. It is highly likely that some parking spaces will be lost, however careful design of the buildings can keep the number of spaces lost to a minimum. Furthermore, buildings should be erected in a manner that does not impede users of the car park from easily accessing and leaving the car parking bays, nor should the buildings make it difficult for users to exit and enter their cars when parked. Finally, it is known that cars occasionally can catch fire, for example due to design faults or poor maintenance, and therefore car park buildings should be designed with this risk in mind. Accordingly, the invention seeks to provide a building for firm ground, such as a car park, a car park including said building, and a method for constructing a building on firm ground, such as a car park, that mitigates at least one of the afore-mentioned problems.

According to one aspect, there is provided a building according to claim 1.

The invention provides a building that is suitable for installation on firm ground, such as a car park, which can be erected quickly on site. The building causes little damage to the surface on which it is mounted, and therefore a car park surface would require little remedial work for it to be operational again. Since the installation is relatively quick, the car park would not be closed for long periods of time, thereby reducing the impact on any nearby facilities such as shops and railway stations. The arrangement of the building distributes loads well, is sufficiently strong and stiff, and can adequately resist horizontal loads. In particular, the provision of ground beams helps to spread the load and resist horizontal loading, and the X-shaped supports provide adequate load bearing capacity and stiffness to the platform support assembly. Furthermore, the building has a relatively small footprint at ground level, which means that many of the car parking bays are retained.

According to another aspect there is provided a building for firm ground, such as a car park.

The building can include a platform.

The building can include at least one habitable structure located on the platform. The habitable structure can comprise at least one wall and a roof.

The building can include a platform support assembly. The platform support assembly can include a first ground beam. The first ground beam is arranged to sit on the ground. The platform support assembly can include a first support. The first support can be mounted on the first ground beam. The first support can be arranged to at least partly support the platform above the ground and to transfer loads from the platform to the first ground beam.

The first support can comprise a first X-shaped support.

The first support and first ground beam can be formed as a prefabricated platform support sub-assembly.

The first support can be located towards a first end of the first ground beam. The first ground beam can be located below a first peripheral portion of the platform. The first peripheral portion can comprise a first lateral side of the platform. The first support can be connected to the first lateral side of the platform, for example by bolts.

The platform support assembly can include a second ground beam. The second ground beam is arranged to sit on the ground. Providing a second ground beam helps to distribute loads and resist horizontal loads. The platform support assembly can include a second support, such as a second X-shaped support. The second support can be mounted on the second ground beam. The second support can be arranged to at least partly support the platform above a car park surface and to transfer loads from the platform to the second ground beam. This increases the load bearing capacity of the platform support assembly and stiffens the assembly. The second support can be mounted towards a first end of the second ground beam. The second ground beam can be arranged parallel to the first ground beam. The second ground beam can be located below a second peripheral portion of the platform. The second peripheral portion can comprise a second lateral side of the platform. The second support can be connected to the second lateral side of the platform, for example by bolts.

The second support and second ground beam can be formed as a prefabricated platform support sub-assembly. The platform support assembly can include a third ground beam. The third ground beam is arranged to sit on the ground. Providing a third ground beam helps to distribute loads and resist horizontal loads. The platform support assembly can include a third support, such as a third X-shaped support. The third support can be mounted on the third ground beam. The third support can be arranged to at least partly support the platform above a car park surface and to transfer loads from the platform to the third ground beam. This increases the load bearing capacity of the platform support assembly and stiffens the assembly. The third ground beam can be arranged parallel to at least one of the first and second ground beams. The third support can be mounted towards a first end of the third ground beam. The third ground beam can be located below a central portion of the platform, for example below a central support beam. The third support can be connected to the central support beam, for example by bolts.

The third support and third ground beam can be formed as a prefabricated platform support sub-assembly.

The platform support assembly can include a further support, such as a further X-shaped support, mounted on the first ground beam. This increases the load bearing capacity of the platform support assembly and stiffens the assembly. The further support can be arranged to at least partly support the platform above a car park surface and to transfer loads from the platform to the first ground beam. The further support can be located towards a second end of the first ground beam. The further support can be connected to the first lateral side of the platform, for example by bolts.

The first support, further support and first ground beam can be formed as a prefabricated platform support sub-assembly.

The platform support assembly can include a further support, such as a further X-shaped support, mounted on the second ground beam. The further support can be arranged to at least partly support the platform above a car park surface and to transfer loads from the platform to the second ground beam. This increases the load bearing capacity of the platform support assembly and stiffens the assembly. The further support can be mounted towards a second end of the second ground beam. The further support can be connected to the second lateral side of the platform, for example by bolts.

The second support, further support and second ground beam can be formed as a prefabricated platform support sub-assembly.

The platform support assembly can include a further support, such as a further X-shaped support, mounted on the third ground beam. The further support can be arranged to at least partly support the platform above a car park surface and to transfer loads from the platform to the third ground beam. This increases the load bearing capacity of the platform support assembly and stiffens the assembly. The further support can be mounted towards a second end of the third ground beam. The further support can be connected to the central support beam, for example by bolts.

The third support, further support and third ground beam can be formed as a prefabricated platform support sub-assembly.

Each X-shaped support can include first and second diagonal members. Each X-shaped support can be mounted on its respective ground beam in a manner such that lower ends of each of the first and second diagonal members are mounted on to the respective ground beam. The X-shaped supports mounted on a ground beam can be aligned with a longitudinal axis of the ground beam. Each X-shaped support can be bolted to its respective ground beam. Each X-shaped support can be prefabricated off site, and can be transported to the car park, for example by lorry.

Each ground beam can be located on the car park surface. That is, it is not necessary to dig a trench to receive the ground beam. This speeds up the building process and minimises damage to the car park surface.

The building has a plurality of parking bays located beneath the platform. Typically, at least two car parking bays are located between the first and second ground beams. In some embodiments at least four car parking bays are located between the first and second ground beams, for example in a 2×2 array. Typically, at least two car parking bays are located between the second and third ground beams. In some embodiments at least four car parking bays are located between the second and third ground beams, for example in a 2×2 array. In some embodiments at least ten car parking bays are located beneath the platform. In some embodiments at least twelve car parking bays are located beneath the platform.

The building can include a first opening on a front side of the building. The first opening is sufficiently large to enable at least one car to drive under the platform. The opening enables a driver to access the parking bays located beneath the platform. The first opening can be located between the first and third ground beams.

The building can include a second opening on a rear side of the building. The second opening is sufficiently large to enable at least one car to drive under the platform. The opening enables a driver to access the parking bays located beneath the platform. The second opening can be located between located between the first and third ground beams.

The building can include a further opening on a front side of the building. The further opening is sufficiently large to enable at least one car to drive under the platform. The opening enables a driver to access the parking bays located beneath the platform. The further opening can be located between the second and third ground beams.

The building can include a further opening on a rear side of the building. The further opening is sufficiently large to enable at least one car to drive under the platform. The opening enables a driver to access the parking bays located beneath the platform. The further opening can be located between the second and third ground beams.

At least one ground beam can comprise a concrete beam. The building can include a plurality of ground beams comprising concrete beams.

At least one ground beam can comprise a steel beam. The building can include a plurality of ground beams comprising steel beams.

At least one ground beam can comprise a steel beam and a concrete beam. This increases the mass of the ground beam for stability purposes. For example, the steel beam can be mounted on top of the concrete beam. The steel beam can be bolted to the concrete beam. At least one X-shaped support can be bolted to the steel beam. The building can include a plurality of ground beams comprising a steel beam mounted on top of a concrete beam.

At least one ground beam can comprise a concrete beam having a steel beam encased within the concrete beam. The encased steel beam can include at least one steel mounting plate that protrudes out of the concrete beam, and may include a plurality of mounting plates. An X-shaped support can be bolted to at least one mounting plate. This type of ground beam provides a stable but manoeuvrable structure, which can be easily connected with a foundation option. It makes assembly of the platform easier. The building can include a plurality of ground beams comprising a steel beam encased in a concrete beam.

At least one ground beam can consist of a steel beam. Each X-shaped support can be bolted to the steel beam. This ground beam arrangement reduces the height (depth) of the ground beam, which can help the ground beam from interfering with car doors when opened. It also reduces the overall weight of the ground beam.

The building can include any suitable number of ground beams, according to the size of the building being constructed.

In some embodiments, at least some of the ground beams have a similar construction.

Each ground beam can be prefabricated off site, and can be transported to the car park, for example by lorry.

The platform support assembly can comprise at least one sub-assembly that is prefabricated off site and that is transported to the car park. For example, a first sub-assembly can comprise the first ground beam and its respective supports, such as the respective X-shaped supports, mounted on the first ground beam. A second sub-assembly can comprise the second ground beam and its respective supports, such as its respective X-shaped supports, mounted on the second ground beam. A third sub-assembly can comprise the third ground beam and its respective supports, such as its respective X-shaped supports, mounted on the third ground beam.

The building can include foundations arranged to transfer loads from at least one ground beam into the ground. In some embodiments, foundations are arranged to transfer loads from at least two of the first, second and third ground beams into the ground. In some embodiments, foundations are arranged to transfer loads from each of the first, second and third ground beams into the ground.

The foundations can include at least one pile foundation. In some embodiments, the building can include a plurality of pile foundations. In some embodiments, a plurality of pile foundations are provided directly below or adjacent each ground beam. Each pile foundation can be connected to its respective ground beam. For example, each pile foundation can include at least one of: a connector plate, a bracket and a channel at an upper end thereof. The connector plate, bracket and/or channel can be bolted to its respective ground beam.

The pile foundations can include at least one pile assembly that includes a hub and a plurality of pile members that are each connected to the hub towards one end. The pile members are distributed about the hub and each pile member is inclined to a vertical axis in the ground. The arrangement is such that ends of the pile members that are distal from the hub flare outwards from the hub. An example of this type of foundation is a RapidRoot™ foundation. The pile foundations can include a plurality of foundation assemblies. This type of foundation provides minimal damage to the car park surface.

The foundations can include at least one helical pile foundation. The pile foundations can include a plurality of helical pile foundations. This type of foundation provides minimal damage to the car park surface.

The platform can be rectangular in plan. The platform can have a front side, a rear side, a first lateral side and a second lateral side. At least part of the first X-shaped support can be connected to the platform adjacent a front side of the platform. At least part of the further X-shaped support mounted on the first ground beam can be connected to the platform adjacent a rear side of the platform. At least part of the second X-shaped support can be connected to the platform adjacent a front side of the platform. At least part of the further X-shaped support mounted on the second ground beam can be connected to the platform adjacent a rear side of the platform. At least part of the third X-shaped support can be connected to the platform adjacent a front side of the platform. At least part of the further X-shaped support mounted on the third ground beam can be connected to the platform adjacent a rear side.

The platform can include a frame. The frame can be metallic. The frame can include steel and/or composite materials. The frame can include a front beam. The frame can include a rear beam. The frame can include a first lateral beam. The frame can include a second lateral beam. The frame can include a central beam. A first end of the central beam can be connected to the front beam. A second end of the central beam can be connected to the rear beam.

The platform can include a floor mounted on the frame. For example, the floor can comprise a plurality of panels. Each panel can comprise concrete, steel and/or a composite construction. The frame can include a plurality of support formations. The panels can be mounted on to the support formations.

The platform frame can include bracing members. The bracing members stiffen the frame.

The platform can be prefabricated off-site. The prefabricated platform can be delivered to the car park by lorry, and can be craned on to the support assembly.

The building can include a first stairway. The first stairway can be arranged to provide access to the platform from the car park. The first stairway can be located adjacent the first lateral side of the platform. This stairway can be attached to the platform to provide lateral stability to the building. The first stairway can include a first set of stairs and a first frame arranged to support an upper end of the first set of stairs. The first frame provides a first landing adjacent the platform.

The building can include a first fire-resistant barrier located adjacent the first stairway. The first fire-resistant barrier can be arranged to isolate the first stairway from the parking bays located beneath the platform. The fire-resistant barrier helps to ensure that residents are able to leave the building via the first stairway in the event of a fire. The first fire-resistant barrier can include block work. The first fire-resistant barrier can include fire-resistant glazing. This enables natural light to illuminate the space under the platform and helps to provide the feel of an open arrangement. The first fire-resistant barrier can include steel panels. The first fire-resistant barrier can be mounted on the first ground beam. This provides an efficient arrangement.

The building can include a second stairway. The second stairway can be arranged to provide access to the platform from the car park. The second stairway can be located adjacent the second lateral side of the platform. This stairway can be attached to the platform to provide lateral stability to the building. The second stairway can include a second set of stairs and a second frame arranged to support an upper end of the second set of stairs. The second frame provides a second landing adjacent the platform.

The building can include a second fire-resistant barrier located adjacent the second stairway. The second fire-resistant barrier can be arranged to isolate the second stairway from the parking bays located beneath the platform. The fire-resistant barrier helps to ensure that residents are able to leave the building via the second stairway in the event of a fire. The second fire-resistant barrier can include block work. The second fire-resistant barrier can include fire-resistant glazing. The second fire-resistant barrier can include steel panels. The second fire-resistant barrier can be mounted on the second ground beam. This provides an efficient arrangement.

At least one of the stairways can be prefabricated off site. The stairways can be delivered to the car park by lorry, can be craned into place, and attached to the platform and/or platform support assembly, for example by bolts. This helps to speed up the construction process.

The at least one habitable structure can comprise a prefabricated unit. The habitable structure can be prefabricated off-site. The prefabricated unit can be delivered to the car park by lorry, and can be craned on to the platform. This helps to speed up the construction process. The habitable structures can be connected to the platform.

A plurality of habitable structures can be mounted on the platform. Any practicable number of habitable structures can be mounted on the platform. For example, 2 to 20 habitable structures can be located on the platform. Typically, the building includes at least 2 habitable structures, and may include at least 4 habitable structures. Typically the building includes less than or equal to 18 habitable structures, and may include less than or equal to 16 habitable structures.

The prefabricated unit can comprise a prefabricated housing unit. Habitable structures other than housing units can be located on the platform, for example at least one of an office unit and a shop unit can be located on the platform.

The platform can be arranged to overhang at least one X-shaped support in a frontwards, rearwards and/or lateral direction. The overhang provides a platform having a larger surface area to accommodate habitable structures having a larger footprint, without disrupting the flow of traffic around the car park. That is, the building footprint does not have to increase to accommodate a habitable structure having a larger footprint.

According to another aspect, there is provided a car park including at least one building according to any configuration described herein. The car park can include a plurality of buildings according to any configuration described herein. The car park includes a plurality of parking bays located beneath the platform. The parking bays are typically defined by lines painted on to the car park surface.

According to another aspect, there is provided a method for constructing a building according to the claims.

The method provides a building that is suitable for installation on firm ground, such as a car park, which can be erected quickly on site and that causes little damage to the car park surface, and therefore the car park surface requires little remedial work for it to be operational again. Since the installation is relatively quick, the car park would not be closed for long periods of time, thereby reducing the impact on any nearby facilities such as shops and railway stations. The arrangement of the building distributes loads well, is sufficiently strong and stiff, and can adequately resist horizontal loads. In particular, the provision of ground beams helps to spread the load and resist horizontal loading, and the X-shaped supports provide adequate load bearing capacity and stiffness to the platform support assembly.

According to another aspect, there is provided a method for constructing a building according to any configuration described herein, on a firm ground site, such as a car park. The car park can be a pre-existing car park. The car park can be an open-air car park. The car park can be a single storey car park. The building can be located on firm ground that is not designated as a car park.

The method can include prefabricating at least one of the following off site and transporting it to the building site: ground beams; supports; platform; platform support sub-assemblies each comprising a ground beam and at least one platform support; and habitable structures.

The method can include prefabricating at least one of the following off site and transporting it to the building site: platform frame; and stairways.

The method can include installing a first set of pile foundations into the ground, for example beneath the car park surface. The method can include mounting the first ground beam, or a first support sub-assembly comprising the first ground beam, on to the ground, for example mounting the first ground beam, or first support sub-assembly, on to the car park surface; and connecting the first ground beam to the first set of pile foundations. The first ground beam can be mounted over or adjacent the first set of pile foundations.

The method can include installing a second set of pile foundations into the ground, for example below the car park surface. The method can include mounting a second ground beam, or a second support sub-assembly comprising the second ground beam, on to the ground, for example mounting the second ground beam, or second support sub-assembly, on to the car park surface, and connecting the second ground beam to the second set of pile foundations. The second ground beam can be mounted over or adjacent the second set of pile foundations.

The method can include installing a third set of pile foundations into the ground, for example below the car park surface. The method can include mounting a third ground beam, or a third support sub-assembly comprising the third ground beam, on to the ground, for example mounting the third ground beam, or third support sub-assembly, on to the car park surface, and connecting the third ground beam to the third set of pile foundations. The third ground beam can be mounted over or adjacent the third set of pile foundations.

The method can include mounting the supports on to the ground beams.

The method can include mounting the platform on top of the supports.

The method can include mounting the prefabricated habitable structure on the platform, for example by means of a crane.

Embodiments of the invention will now be described by way of example only with reference to the drawings, wherein.

Figure 1:
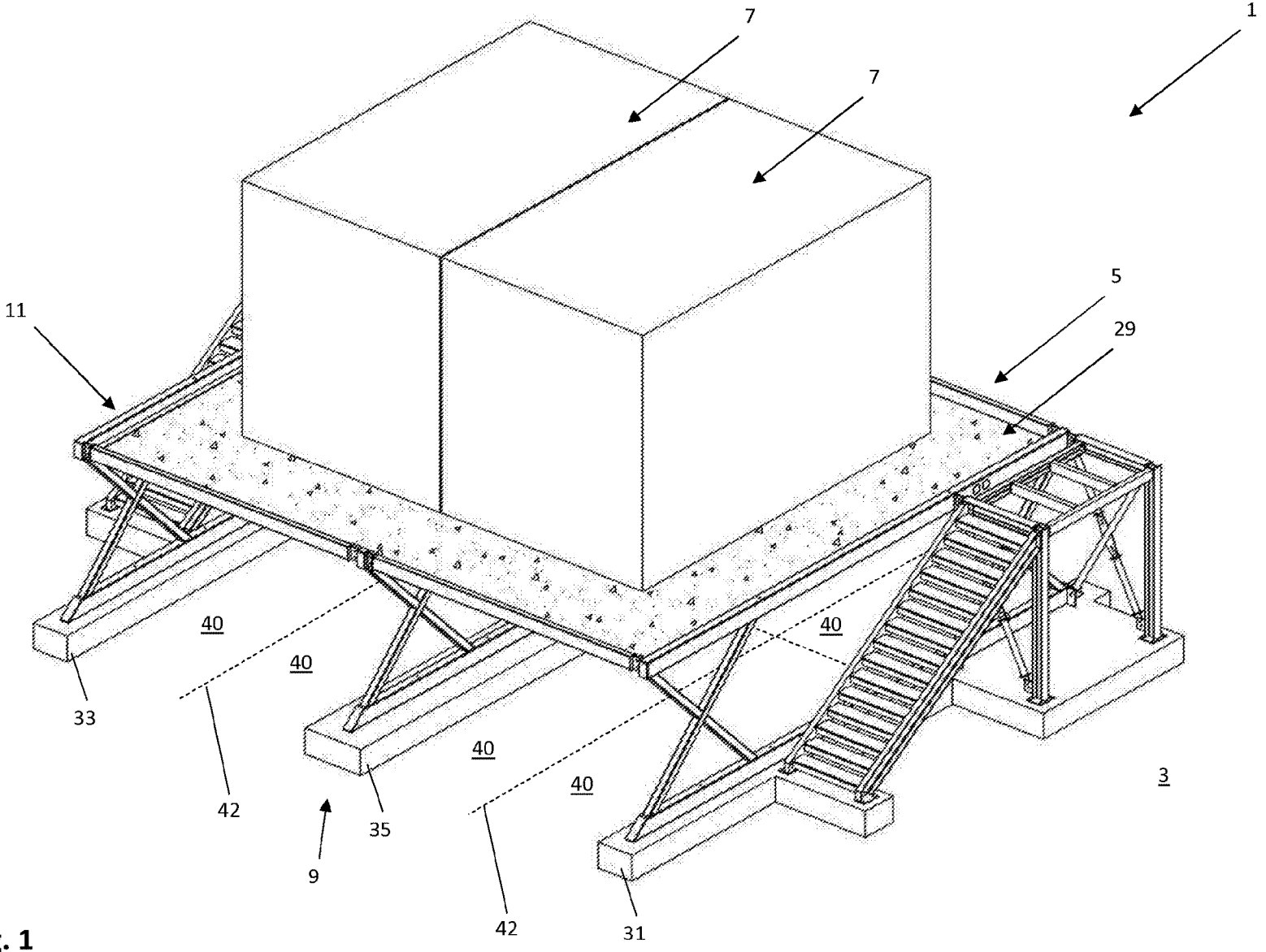
FIG. 1 is an isometric view of a building according to a first embodiment of the invention.

FIG. 1 shows a building 1 for firm or compacted ground such as a car park 3 in accordance with a first embodiment of the invention. The building 1 includes: a platform 5, at least one habitable structure 7 mounted on the platform 5, and a platform support assembly 9 arranged to support the platform 5 above the car park 3 surface.

The platform 5 can be generally rectangular in plan, but can have alternative shapes. The platform 5 includes a frame 11. The frame 11 includes a front beam 13 shown in FIG. 2, a rear beam 15 and a first lateral beam 17 and a second lateral beam 19. Each beam 13,15,17,19 comprises at least one steel member, and can comprise a plurality of steel members connected together, for example by bolting or welding. Each steel member can comprise a rectangular hollow section (RHS), having end brackets that can be bolted together. The frame 11 includes a central beam 21, which extends from the rear beam 15 to the front beam 19. The central beam 21 is arranged parallel to the lateral beams 17,19. In the arrangement, the lateral beams 17,19 and the central beam 21 each comprise a RHS member. The front beam 13 comprises first and second RHS members 13*a*,13*b*. The first RHS member 13*a* is bolted to the first lateral beam 17 and to the central beam 21. The second RHS member 13*b* is bolted to the central beam 21 and the second lateral beam 19. The rear beam 15 comprises first and second RHS members 15*a*,15*b*. The first RHS member 15*a* is bolted to the first lateral beam 17 and to the central beam 21. The second RHS member 15*b* is bolted to the central beam 21 and the second lateral beam 19. Two additional RHS members 23*a*,23*b* are included in the frame 11. The first additional RHS member 23*a* is bolted to the first lateral beam 17 and the central beam 21, and reinforces the frame 11. The first additional RHS member 23*a* is arranged parallel with the RHS member 15*a*, and is spaced apart from the RHS member 15*a*, being located at a position that is approximately one third of the length of the central beam 21, starting from the RHS member 15*a*. The second additional RHS member 23*b* is bolted to the second lateral beam 17 and the central beam 21, and reinforces the frame 11. The second additional RHS member 23*b* is arranged parallel with the RHS member 15*ba*, and is spaced apart from the RHS member 15*b*, being located at a position that is approximately one third of the length of the central beam 21, starting from the RHS member 15*b*. The first and second additional RHS members 23*a*,23*b* are arranged substantially coaxially.

Bracing members 25 are provided to tension the frame 11. Bracing members 25 tie the first lateral beam 17 to the central beam 21. Bracing members 25 tie the second lateral beam 19 to the central beam 21.

The lateral beams 17,19 and the central beam 21 include support formations 27, which are arranged to support a concrete floor 29. The concrete floor 29 is shown diagrammatically in FIG. 1. The concrete floor 29 typically comprises an arrangement of pre-fabricated concrete panels. The concrete panels can be craned on to the frame 11 to create the floor. The habitable structures 7 are mounted on to the concrete floor 29. The floor 29 has a larger surface area than the combined area of the habitable structures 7, which provides the platform 5 with a walkway adjacent the housing units. Optionally, a surface finish can be applied to the floor 29 in at least some areas in order to improve the aesthetic of the walkway and/or improve its walkway function. A balustrade (not shown) can be fitted to the platform 5 for safety reasons. For example, the balustrade can be fitted adjacent at least some of the front, rear, and lateral sides of the platform 5.

The platform 5, and hence everything mounted on the platform 5, is supported above the car park 3 surface by means of the platform support assembly 9. The platform support assembly 9 includes first, second and third ground beams 31,33,35. The ground beams 31,33,35 sit on top of the car park surface. Platform supports 37,39 are mounted on the first ground beam 31. The supports 37,39 can be X-shaped. The supports 37,39 and the first ground beam 31 can be in the form of a first prefabricated support sub-assembly to speed up assembly on site. The supports 37,39 are connected to platform 5, typically to the first lateral beam 17. Platform supports 41,43 are mounted on the second ground beam 33. The supports 41,43 can be X-shaped. The supports 41,43 and the second ground beam 33 can be in the form of a second prefabricated support sub-assembly to speed up assembly on site. The supports 41,43 are connected to platform 5, typically to the second lateral beam 19. Platform supports 45,47 are mounted on the third ground beam 35. The supports 45,47 can be X-shaped. The supports 45,47 and the third ground beam 35 can be in the form of a third prefabricated support sub-assembly to speed up assembly on site. The supports 45,47 are connected to platform 5, typically to the central beam 21.

Each of the first, second and third ground beams 31,33,35 comprises a concrete beam 31*a*,33*a*,35*a* and a steel beam 31*b*,33*b*,35*b*, typically an RHS member, mounted on top of its respective concrete beam 31*a*,33*a*,35*a*, and is bolted thereto. Each steel beam 31*b*,33*b*,35*b* is arrange parallel to its respective concrete beam 31*a*,33*a*,35*a*. Loads are transferred from the platform 5 to the ground beams 31,33,35 via the X-shaped supports 37-47. The ground beams 31,33,35 help to spread the loads received, and to resist any horizontal loading on the building 1.

Each X-shaped support 37-47 comprises a first diagonal member comprising a single piece of steel square hollow section (SHS) and a second diagonal member comprising two pieces of SHS butt welded to the first diagonal member. The angle subtended between central longitudinal axes of the first and second diagonal members is typically in the range 40 to 90 degrees. Each X-shaped support 37-47 can be bolted to its respective ground beam 31,33,35, for example via a flat plate connector located towards the end of each diagonal member. Alternatively, each X-shaped support 37-47 can be welded to its respective ground beam 31,33,35. Similarly, each X-shaped support 37-47 can be bolted to its respective platform beam 17,19,21, for example via a flat plate connector located towards the end of each diagonal member. Alternatively, each X-shaped support 37-47 can be welded to its respective platform beam 17,19,21.

The X-shaped supports 37-47 are mounted on their respective ground beams 31,33,35 such that lower ends of both the first and second diagonal members are attached to the respective ground beam 31,33,35. The X-shaped supports 37-47 are connected to their respective platform frame members 17,19,21 such that upper ends of both the first and second diagonal members are attached to the platform frame members 17,19,21. Thus, the first ground beam 31, its respective X-shaped supports 37,39, and the first lateral beam 17 are arranged in a first vertical plane. The second ground beam 33, its respective X-shaped supports 41,43, and the second lateral beam 19 are arranged in a second vertical plane. The third ground beam 35, its respective X-shaped supports 45,47, and the central beam 21 are arranged in a third vertical plane.

The ground beams 31,33,35 shown in FIG. 1, run from the front of the building to the rear of the building. The ground beams 31,33,35 are spaced apart in the lateral direction. The building 1 has an open structure at the front. The building has first and second openings at the front. The first opening is located between the first and third ground beams 31,35. The second opening is located between the second and third ground beams 33,35. The building 1 has an open structure at the rear. The building has third and fourth openings at the rear. The third opening is located between the first and third ground beams 31,35. The fourth opening is located between the second and third ground beams 33,35. In some embodiments, there is no barrier between first and third ground beams 31,35 that blocks passage of a vehicle under the platform 5, thus a driver is able to drive a vehicle under the platform 5 through any one of the first and third openings and to drive out via the other one of the first and third openings. In some embodiments, there is no barrier between second and third ground beams 31,35 that blocks passage of a vehicle under the platform 5, thus a driver is able to drive a vehicle under the platform 5 through any one of the second and fourth openings and to drive out via the other one of the second and fourth openings. In other embodiments, barriers can be provided below the platform 5 to separate front parking bays from rear parking bays.

Car parking bays 40 are located on the car park surface directly below the platform 5. There are at least two parking bays 40 located beneath the platform 5, between each pair of ground beams 31,33,35. Typically, there are at least four parking bays 40 between each pair of ground beams 31,33,35, for example arranged in a 2×2 array. FIG. 1 illustrates the parking bays 40 arranged in a 2×2 array by means of dashed lines 42. Since the building 1 has an open structure at the front and rear between each pair of ground beams 31,33,35, a driver is able to drive into the park bays via any of the front and rear openings. Typically, the height between the underside of the platform 5 and the car park surface is typically in the range 2.2 to 2.8 m, and typically around 2.4 m. This provides sufficient clearance for most cars.

Figure 2:
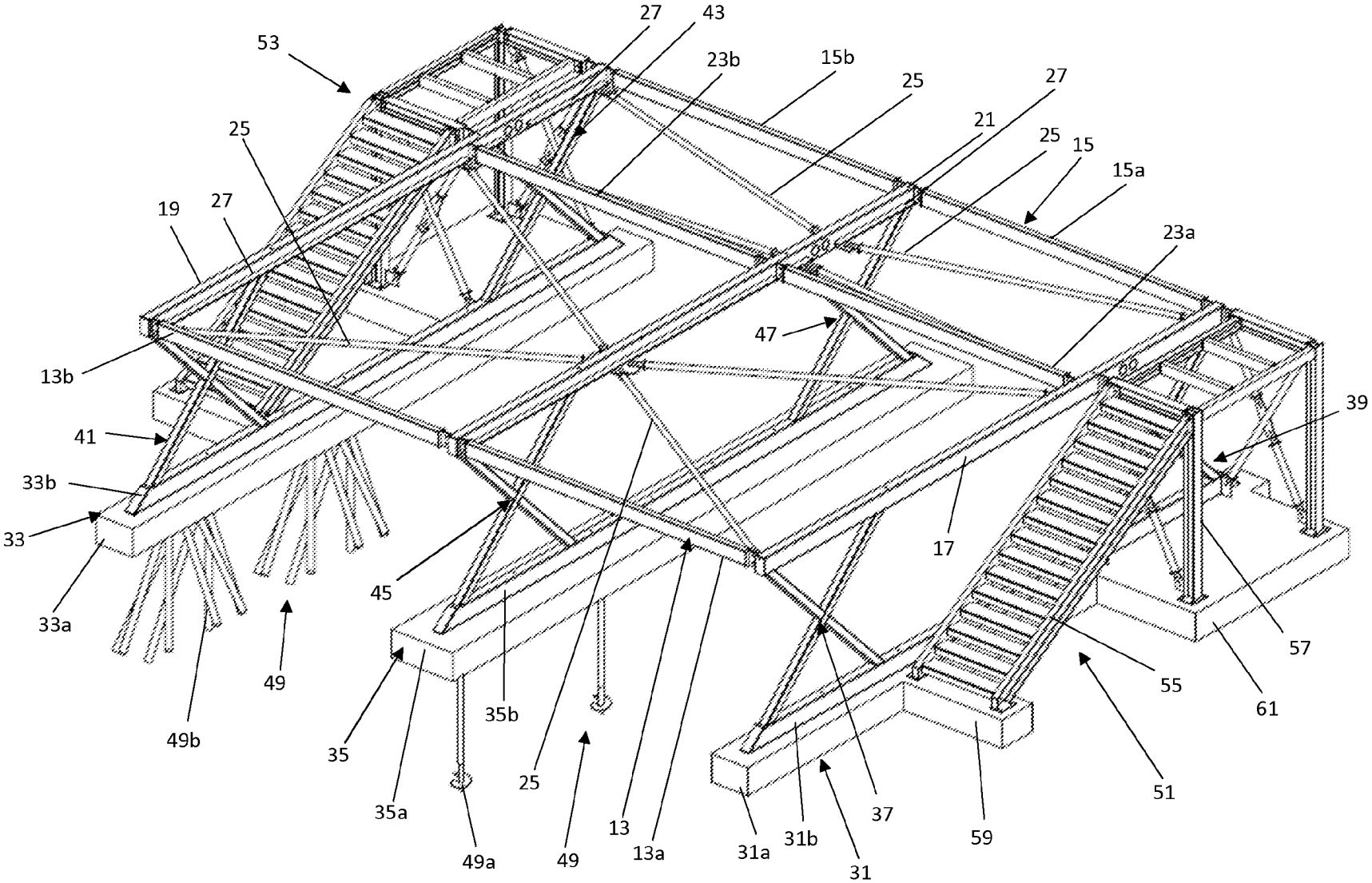
FIG. 2 is an isometric view of a platform, a platform support assembly and foundation arrangement of the embodiment of FIG. 1.

Loads from the platform support assembly 9, shown in FIG. 2, are transferred into the ground beneath the car park by foundations 49. Appropriate foundations 49 are selected to suit the ground conditions. Particularly preferred foundations 49 are helical pile foundations 49*a* and RapidRoot™ foundations 49*b*. Both of these types of foundations are made from metal, typically steel, and therefore do not require a concrete pour on-site. RapidRoot™ foundations 49*b* have a hub including a connecting plate and several tubular members that are inserted into the ground in an angular fashion, such that the members flare outwards. Helical pile foundations 49*a* have a connecting plate, an elongate body and at least one helical formation mounted on the body. Helical pile foundations 49*a* are screwed vertically into the ground. Both of these types of foundations 49*a*,49*b* are quickly and easily inserted into the ground, even in bad weather conditions, only causing minimal damage to the car park surface. The damage to the car park surface is localised to the foundation 49*a*,49*b*, that is only to the immediate area where the pile is inserted. Both types of foundation 49*a*,49*b* can be loaded under compression and tension. Load can be applied to the foundations 49*a*,49*b* immediately after installation, which is different from concrete piles, which have to set before a load can be applied.

The foundations 49 are positioned into the ground directly below where each of the ground beams 31,33,35 will be located on the car park surface. The foundations 49 are distributed along the lengths of the first, second and third ground beams 31,33,35. This is illustrated diagrammatically in FIG. 2, which shows two RapidRoot™ 49*b* foundations supporting the second ground beam 33 and two helical pile 49*a* foundations supporting the third ground beam 35. In FIG. 2, foundations 49 are not shown below the first ground beam 31 for the purposes of clarity. The number and type of foundations 49 for the building 1 will be determined by an engineer according to the ground conditions. For example, the foundations 49 can comprise only RapidRoot™ 49*b* foundations. The foundations can comprise only helical pile 49*a* foundations. Alternatively, the foundations can comprise some RapidRoot™ 49*b* foundations and some helical pile 49*a* foundations. Typically, each ground beam 31,33,35 will have at least first and second foundations 49, for example the first foundation located towards a front end of the ground beam and the second foundation located towards a rear end of the ground beam. Each ground beam 31,33,35 can have at least one further foundation 49 located intermediately between the first and second foundations.

The foundations 49 are connected to their respective ground beams 31,33,35 by bolting, or welding at least one of the connector plates, brackets and channels to the foundation load points, and typically bolting to, or through, the ground beams.

As mentioned above, the building 1 includes at least one habitable structure 7 mounted on to the platform 5. Typically, the building 1 includes a plurality of habitable structures. The building 1 can include any practicable number of habitable structures 7, for example the building 1 can include 2 to 20 habitable structures 7. Some embodiments have 4 to 16 habitable structures 7. FIG. 1 shows two habitable structures 7 mounted on to the platform 5. If a greater number of habitable structures 7 are mounted on to the platform 5, the dimensions of the platform 5, the arrangement of the platform support assembly 9, and the foundation assembly 11 are adjusted accordingly. Each habitable structure 7 can comprise a pre-fabricated unit. Each pre-fabricated unit can be transported to the car park 3 on a lorry and can be lifted on to the platform 5 using a crane. For example, each habitable structure can comprise a pre-fabricated housing unit, such as a KODA® house supplied by Kodasema OÜ. Each habitable structure can have a footprint of 28 $m^2$ or more, with a usable floor area of around 26 $m^2$. Exact dimensions can be adjusted to suit the particular car park and housing scheme. Each pre-fabricated unit can have a concrete structure, which weighs around 27 tonnes. Alternatively, lighter weight pre-fabricated units can be used, which have a wooden structure, or steel reinforced wooden structure, these weigh around 10 tonnes. Approximate minimum habitable space dimensions are 7 m×4 m×4 m, with alternative designs for larger units.

The habitable structures 7 can be mounted on to the platform 5 side by side.

Figure 3:
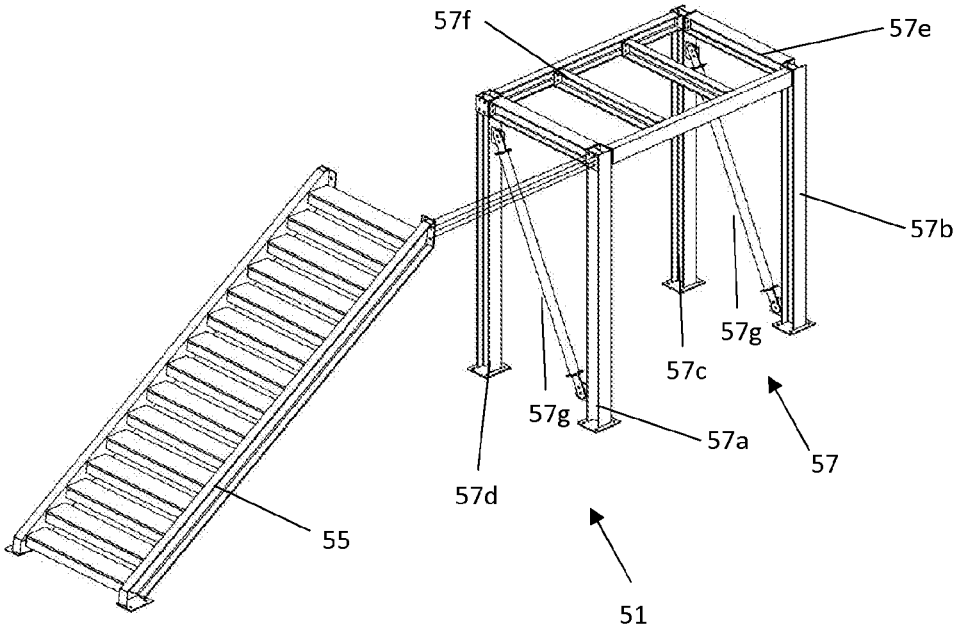
FIG. 3 is an enlarged isometric view of a modular stairway of the embodiment of FIG. 1.

The building 1 includes first and second stairways 51,53. The stairways 51,53 provide access from the car park to the platform 5. The first stairway 51 is located adjacent to the first lateral beam 17. The second stairway 53 is located adjacent to the second lateral beam 19. FIG. 3 shows an enlarged, partially exploded view, of the first stairway 51. The stairway 51 includes the stairs 55 and a support structure 57. The support structure 57 is typically made from steel, and includes an arrangement of welded RHS or SHS members. The support structure 57 includes four vertical members 57*a*-57*d* and a rectangular top frame 57*e* having transverse bracing members 57*f*. The support structure 57 also includes diagonal bracing members 57*g*. One of the bracing members 57*g* braces a first pair 57*a*,57*d* of the vertical members. One of the bracing members 57*g* braces a second pair 57*b*,57*c* of the vertical members.

The second stairway 53 is similar to the first stairway 51 but is opposite handed to suit connection to the platform 5 adjacent the second lateral beam 19.

Each stairway 51,53 can be pre-fabricated offsite and is transported to the car park, for example on a lorry. This enables each stairway 51,53 to be installed quickly on site.

Also, the arrangement of the stairways 51,53 means that they are suitably braced for transportation, without being damaged during transportation. Each stairway 51,53 is bolted to the platform support assembly 9 to provide stability in a transverse direction. The first stairway 51 is mounted on, and is bolted to, additional ground beams 59,61, which can be connected to the first ground beam 31. The second stairway 53 is mounted on, and is bolted to, additional ground beams 59,61, which can be connected to the second ground beam 33.

The X-shaped supports, particularly in combination with the stairways, provide a good compromise for supporting static loads from the platform 5, horizontal loads applied to the building, and resisting torsional loads generated to prevent the building 1 from twisting.

The method of constructing the building 1 on a pre-existing car park 3, such as an open-air single storey pre-existing car park, can include at least some of the following steps:

Prefabrication of components and subassemblies, including prefabricated support sub-assemblies having ground beams 31,33,35 and X-shaped supports 37-47; habitable structures 7; platform 5 components; and stairways 51,53.

Installing, first, second and third sets of pile foundations 49 beneath the car park 3 surface. Appropriate piling machines are used according to type of pile foundations used. Typically, each pile foundation is inserted with minimal disruption to the car park surface.

Transporting the prefabricated components and subassemblies to the car park.

Installing the first prefabricated support sub-assembly such that the first ground beam 31 is laid on the car park surface above or adjacent to the first set of pile foundations 49, with the supports 37,39 oriented upwards. The first ground beam 31 is connected to the first set of pile foundations 49, for example by bolts.

Installing the second prefabricated support sub-assembly such that the second ground beam 33 is laid on the car park surface above or adjacent to the second set of pile foundations 49, with the supports 41,43 oriented upwards. The second ground beam 33 is connected to the second set of pile foundations 49.

Installing the third prefabricated support sub-assembly such that the third ground beam 33 is laid on the car park surface above or adjacent to the third set of pile foundations 49, with the supports 45,47 oriented upwards. The third ground beam 33 is connected to the third set of pile foundations 49, for example by bolts.

Mounting the platform 5 on top of the X-shaped supports 37-47.

Optionally, the X-shaped supports 37-47 can be mounted on to their respective ground beams 31,33,35 on site in some circumstances.

Mounting the prefabricated habitable structures on to the platform, for example by a crane.

Attaching the stairways 51,53 to at least one of: the platform 5, one of the ground beams 31,35, and the platform support assembly 9.

Figure 4:
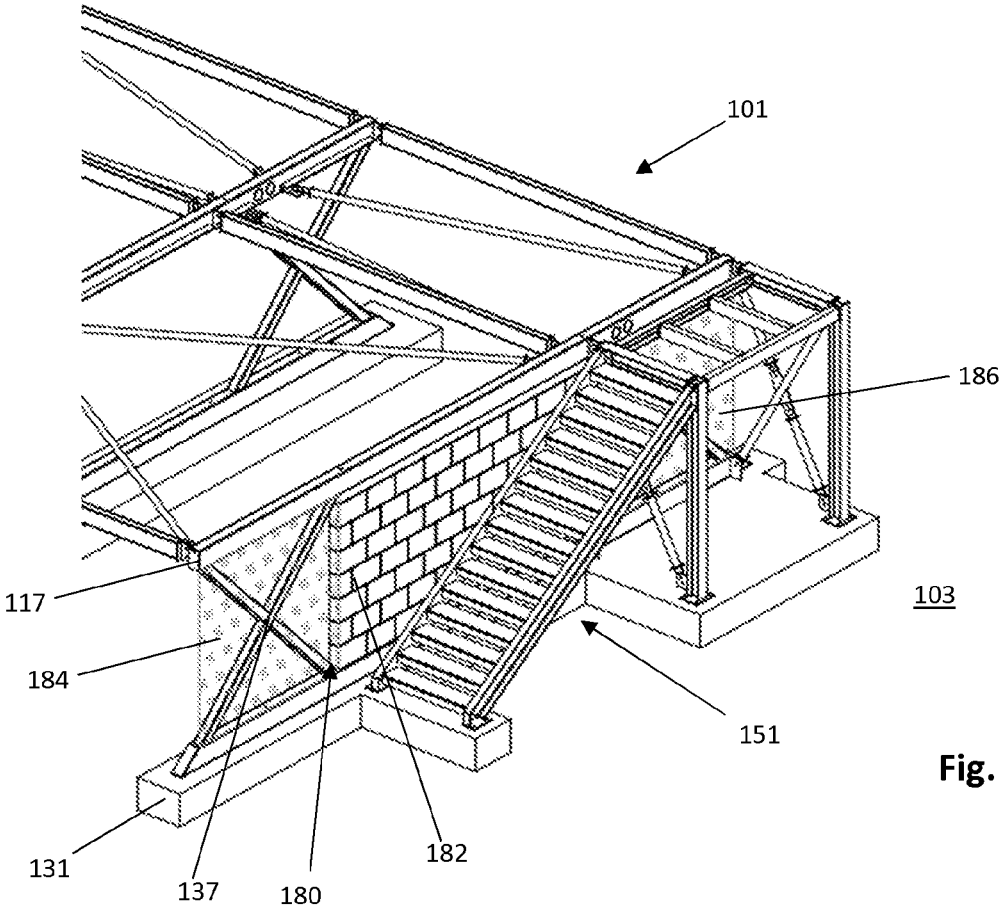
FIG. 4 is an isometric view of part of a platform support assembly of a second embodiment of the invention, which includes a fire barrier to protect the stairway.

FIG. 4 shows a building 101 for a car park 103 in accordance with a second embodiment of the invention. The building 101 of the second embodiment is similar to the building 1 of the first embodiment, except that the first and second stairways are protected by respective fire-resistant barriers 180. The fire-resistant barriers 180 seal off the stairways to ensure that the stairways can be used as a means of escape for the residents in the event of a fire. Each fire-resistant barrier 180 can have several different arrangements, depending on the specific needs of the site. For example, FIG. 4 shows a fire-resistant barrier 180 adjacent the first stairway 151 comprising a section of blockwork 182 and first and second sections of glazing 184,186, which are sealed to the blockwork. The barrier 180 is used to seal off the first stairway 151. The blockwork 182 and sections of glazing 184,186 are mounted on to the first ground beam 131, and extend upwards to the first lateral beam 117. The glazing 184,186, as well as providing a fire-resistant barrier, is transparent and therefore maintains an open feel to the structure. Typically, the first glazing section 184, is located adjacent to the first X-shaped support 137, and the second glazing section 186 is located adjacent the second X-shaped support. The blockwork 182 is located between the first and second sections of glazing 184,186. A similar arrangement can be provided adjacent the second stairway. Any other suitable fire-resistant barriers 180 can be used. For example, each fire-resistant barrier 180 can comprise glazing along the full length of the respective ground beam; blockwork along the full length of the respective ground beam; or light-gauge steel (LGS) studs. Cladding, boarding and/or paint can be applied to parts or all of the fire-resistant barrier 180 as required.

Figure 5:
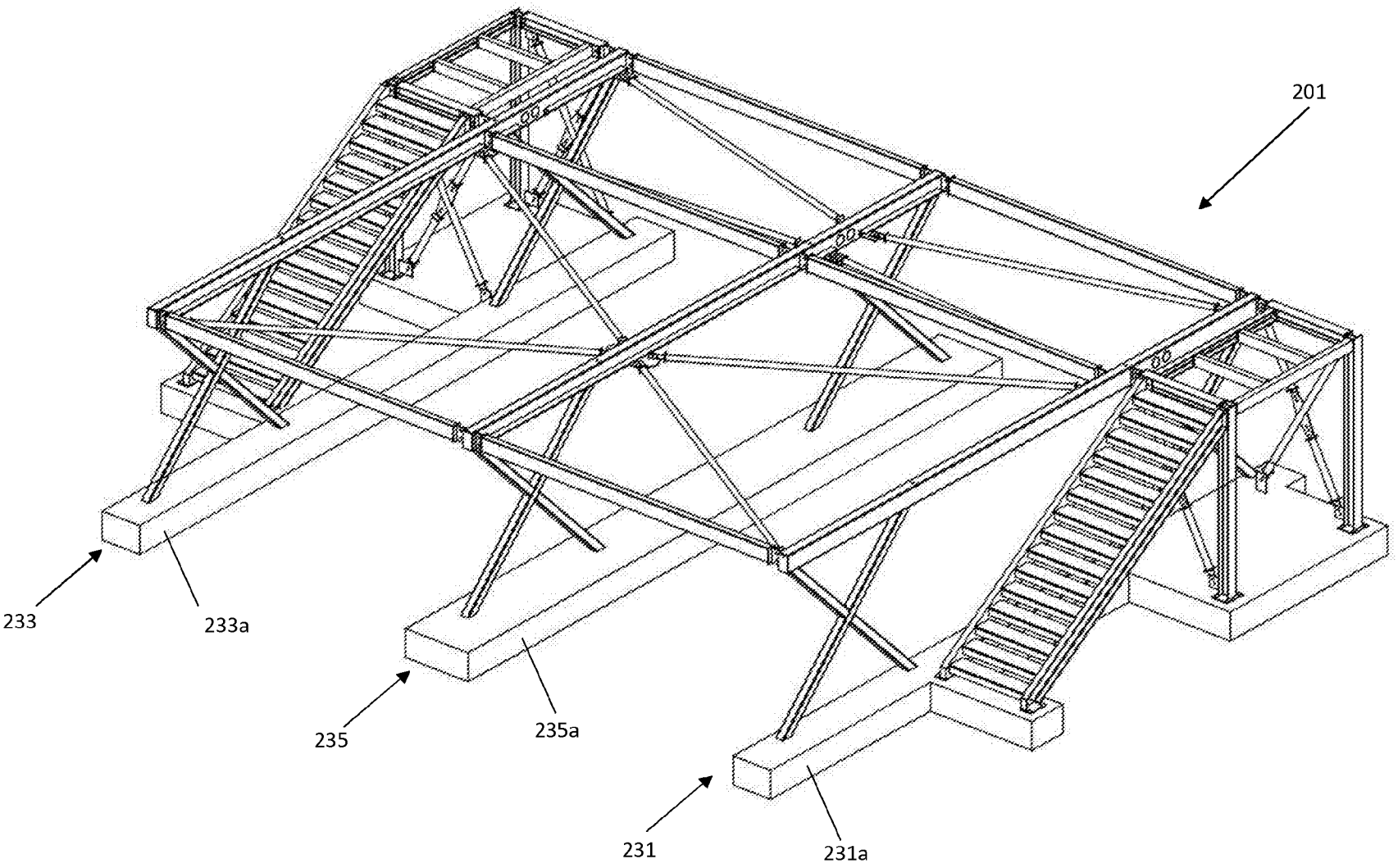
FIG. 5 is an isometric view of a platform and a platform support assembly according to a third embodiment of the invention.

FIG. 5 shows a building 201 for a car park 103 in accordance with a third embodiment of the invention. The building 201 can be arranged similarly to the building 1 of the first embodiment or the building 101 of the second embodiment, except that the ground beams 231,233,235 have a different construction. In the first and second embodiments, each ground beam comprises a steel beam mounted on top of a concrete beam. In the third embodiment, each ground beam 231,233,235 comprises a steel beam (not shown) encased within a concrete beam 231*a*,233*a*,235*a*. Each encased steel beam can include steel mounting plates that protrudes out of the respective concrete beam 231*a*, 233*a*,235*a*. Each of the X-shaped supports are bolted to their respective steel mounting plates. The advantage of this ground beam arrangement is to provide a stable but manoeuvrable structure to connect to foundation options, and make assembly of the platform more straightforward. This can help to greatly simplify the levelling of the supports and platform, without compromising the ability of the ground beams 231,233,235 to stabilise the building 201.

Figure 6:
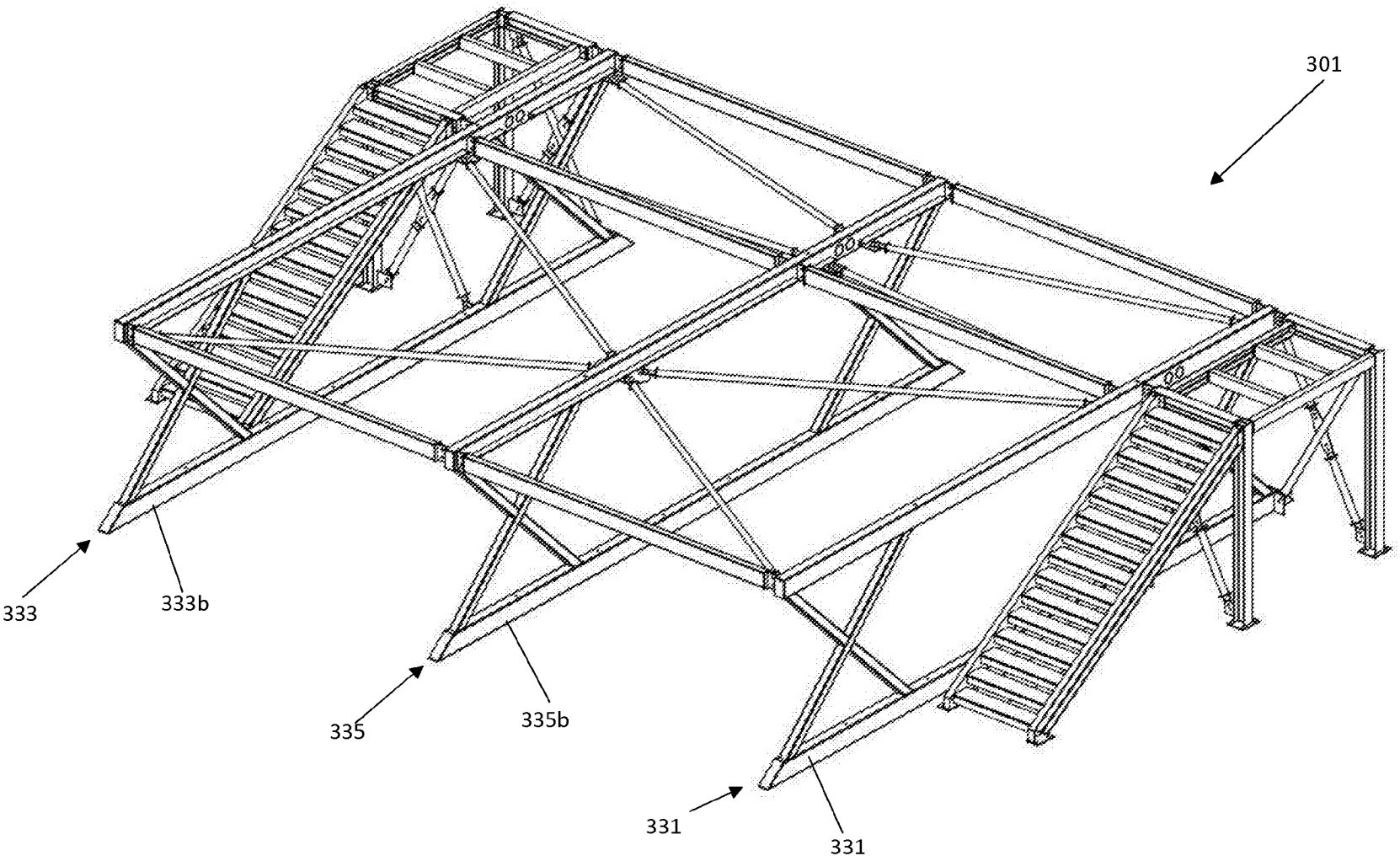
FIG. 6 is an isometric view of a platform and a platform support assembly according to a fourth embodiment of the invention.

FIG. 6 shows a building 301 for a car park 103 in accordance with a fourth embodiment of the invention. The building 301 can be arranged similarly to the building 1 of the first embodiment or the building 101 of the second embodiment, except that the ground beams 331,333,335 have a different construction. In the first and second embodiments, each ground beam comprises a steel beam mounted on top of a concrete beam. In the fourth embodiment, each ground beam 231,233,235 comprises a steel beam 231*b*, 233*b*,235*b* only, that is no concrete beam is present at all. This reduces the weight of the overall structure, which may be useful for some ground conditions and has the advantage of reducing the overall height of the ground beams 231,233, 235, which reduces the possibility of the ground beams 231,233,235 from interfering with car doors when they are opened. In this arrangement, the steel beams 231*b*,233*b*, 235*b* are bolted directly to the foundations, when used.

It will be appreciated by the skilled person that modifications can be made to the above embodiments that fall within the scope of the invention, for example in some instances the ground conditions may be such that no foundations 49 are required for at least one of the ground beams, and possibly all of the ground beams. For some ground conditions, it may be possible to bolt the ground beams to the car park surface instead of using foundations.

Any suitable number of X-shaped supports can be mounted on to the ground beams. The number is typically selected according to the size of the platform and the number of habitable structures mounted thereon. For example, a ground beam can have one X-shaped support mounted thereon. A ground beam can have at least three X-shaped supports mounted thereon.

Supports other than X-shaped supports can be mounted on to at least one ground beam to support the platform above car park surface.

The building may have a different number of ground beams. Any suitable number of ground beams can be used. The number is typically selected according to the size of the platform and the number of habitable structures mounted thereon.

Other types of foundations can be used for some embodiments in addition to the pile foundations, if the ground conditions require such foundations.

Figure 7:
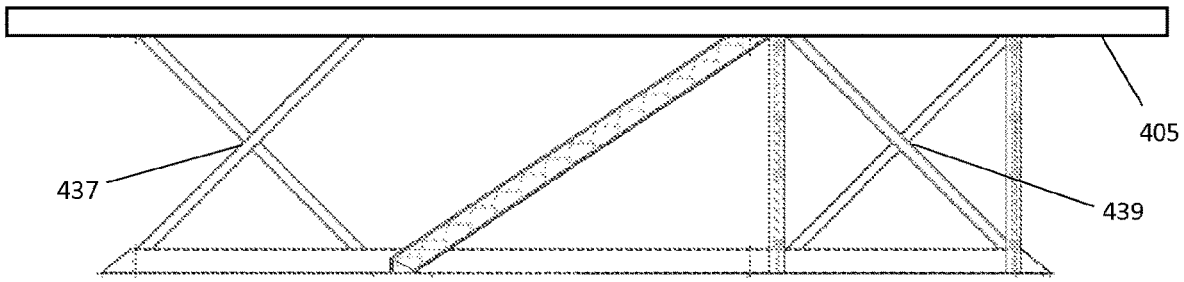
FIG. 7 is a side view of part of a building having a support assembly and a platform that overhangs the support assembly.

In some embodiments, the platform may extend outwards beyond the X-shaped supports, thereby creating at least one overhang portion of the platform. This increases the area of the platform. For example, the platform may overhang the X-shaped supports in a frontward direction. The platform may overhang the X-shaped supports in a rearward direction. The platform may overhang the X-shaped supports in at least one lateral direction. Having a platform that overhangs at least some of the X-shaped supports, in at least one direction, can be useful to accommodate larger sized habitable structures on the platform without increasing the footprint of the car park building and without significantly disrupting the flow of traffic around the car park. It is envisaged, that at least some embodiments will overhang the X-shaped supports in both the frontwards and rearwards directions. This is illustrated in FIG. 7, which shows a platform 405 overhanging front and rear X-shaped supports 437,439.

While the primary use for the building is for it to be constructed on a car park, it will be appreciated that the building can be constructed on firm/compacted ground that is not a car park.

The following description presents exemplary embodiments and, together with the drawings, serves to explain principles of the invention. However, the scope of the invention is not intended to be limited to the precise details of the embodiments or exact adherence with all method installation steps, since variations will be apparent to a skilled person and are deemed also to be covered by the claims. Terms for components used herein should be given a broad interpretation that also encompasses equivalent functions and features. In some cases, several alternative terms (synonyms) for structural features have been provided but such terms are not intended to be exhaustive.

Descriptive terms should also be given the broadest possible interpretation; e.g. the term "comprising" as used in this specification means "including" such that interpreting each statement in this specification that includes the term "comprising", features other than that or those prefaced by the term may also be present. Related terms such as "comprise" and "comprises" are to be interpreted in the same manner. Directional terms such as "vertical", "horizontal", "up", "down", "upper" and "lower" may be used for convenience of explanation usually with reference to the illustrations and are not intended to be ultimately limiting if an equivalent function can be achieved with an alternative dimension and/or direction.

The description herein refers to embodiments with particular combinations of configuration steps or features, however, it is envisaged that further combinations and cross-combinations of compatible steps or features between embodiments will be possible. Indeed, isolated features may function independently as an invention from other features and not necessarily require implementation as a complete combination. Any feature from an embodiment can be isolated from that embodiment and included in any other embodiment.

The invention claimed is:

1. A building constructed on firm ground, such as a car park, said building, including:

a platform;

at least one habitable structure located on the platform, the habitable structure comprising at least one wall and a roof;

a platform support assembly, including a first ground beam seated on the ground and a first support arranged to at least partly support the platform above the ground and to transfer loads from the platform to the first ground beam, a second ground beam seated on the ground, and a second support arranged to at least partly support the platform above a car park surface and to transfer loads from the platform to the second ground beam;

foundations arranged to transfer loads from the first ground beam and/or the second ground beam into the ground, wherein the foundations include at least one pile foundation;

a plurality of parking bays located on the ground beneath the platform; and a first opening on a front side of the building, which is sufficiently large to enable at least one car to drive under the platform to access the parking bays; and/or a second opening on a rear side of the building, which is sufficiently large to enable at least one car to drive under the platform to access the parking bays.

2. The building according to claim 1, wherein the first support comprises a first X-shaped support.

3. The building according to claim 1, wherein the second support comprises a second X-shaped support.

4. The building according to claim 1, wherein the platform support assembly includes a third ground beam arranged to sit on the ground, and a third support mounted arranged to at least partly support the platform above a car park surface and to transfer loads from the platform to the third ground beam.

5. The building according to claim 4, wherein the third support comprises a third X-shaped support.

6. The building according to claim 2, wherein the platform support assembly includes a further X-shaped support arranged to at least partly support the platform above a car park surface and to transfer loads from the platform to the first ground beam.

7. The building according to claim 2, wherein the platform support assembly includes a further X-shaped support arranged to at least partly support the platform above a car park surface and to transfer loads from the platform to the second ground beam.

8. The building according to claim 4, wherein the platform support assembly includes a further X-shaped support arranged to at least partly support the platform above a car park surface and to transfer loads from the platform to the third ground beam.

9. The building according to claim 2, wherein the first X-shaped support includes first and second diagonal members, wherein the first X-shaped support is mounted on its respective ground beam in a manner such that lower ends of each of the first and second diagonal members are mounted on to the respective ground beam.

10. The building according to claim 1, including a further opening located on the front side of the building, which is sufficiently large to enable at least one car to drive under the platform.

11. The building according to claim 1, including a further opening located on the rear side of the building, which is sufficiently large to enable at least one car to drive under the platform.

12. The building according to claim 1, wherein the first ground beam and/or the second ground beam comprises a concrete beam and a steel beam mounted on top of the concrete beam.

13. The building according to claim 1, wherein the first ground beam and/or the second ground beam comprises a concrete beam having a steel beam encased within the concrete beam.

14. The building according to claim 1, wherein the first ground beam and/or the second ground beam comprises a steel beam.

15. The building according to claim 1, wherein the pile foundations include at least one pile assembly that includes a hub and a plurality of pile members that are each connected to the hub at a proximal end, the pile members being distributed about the hub, wherein each pile member is inclined to a vertical axis in the ground such that distal ends of the pile members flare outwards from the hub.

16. The building according to claim 1, wherein the foundations include at least one helical pile foundation.

17. The building according to claim 1, including a first stairway, which is arranged to provide access to the platform from the ground; and a first fire-resistant barrier located adjacent the first stairway, the first fire-resistant barrier is arranged to isolate the first stairway from the parking bays located beneath the platform.

18. The building according to claim 1, wherein the at least one habitable structure comprises a prefabricated unit.

19. The building according to claim 1, wherein at least one of the following is prefabricated off site: the supports; the ground beams; sub-assemblies comprising a ground beam and at least one support; the platform; and a platform frame.

20. The building according to claim 1, wherein the platform overhangs the first support in a frontwards, rearwards and/or lateral direction; and/or the second support in a frontwards, rearwards and/or lateral direction.

21. A car park including at least one building according to claim 1 including a plurality of parking bays located beneath the platform.

* * * * *